United States Patent [19]

Holt et al.

[11] 4,003,463

[45] Jan. 18, 1977

[54] APPARATUS FOR TRANSPORTING BUNDLES OF FLAT ARTICLES

[75] Inventors: Barrie Holt, Poynton; Jeremy Peter Barlow, Northwich, both of England

[73] Assignee: Henry Simon Limited, Stockport, England

[22] Filed: June 5, 1975

[21] Appl. No.: 583,890

[30] Foreign Application Priority Data

Jan. 8, 1974 United Kingdom ..... 25560/74

[52] U.S. Cl. ..... 198/374; 198/415; 198/462

[51] Int. Cl.[2] ..... B65G 47/24

[58] Field of Search ..... 198/35, 235, 283; 214/8.5 A, 8.5 SS; 271/3.1, 150, 151

[56] References Cited

UNITED STATES PATENTS

| | | | |
|---|---|---|---|
| 2,278,140 | 3/1942 | Sieger | 214/8.5 A |
| 3,447,696 | 6/1969 | Calistrat | 198/235 X |
| 3,459,420 | 8/1969 | Huntwork | 198/76 X |
| 3,602,358 | 8/1971 | Jakobsson | 214/8.5 A |
| 3,643,939 | 2/1972 | Nussbaum | 214/8.5 A |
| 3,838,292 | 9/1974 | Sullivan | 198/283 X |
| 3,850,319 | 11/1974 | DiFrank et al. | 198/35 X |

*Primary Examiner*—Johnny D. Cherry
*Assistant Examiner*—Richard K. Thomson
*Attorney, Agent, or Firm*—Norris & Bateman

[57] ABSTRACT

Apparatus for feeding rectangular blanks of corrugated paper board from a stack thereof comprising means for delivering the blanks onto a first conveyor belt in such a manner that the blanks extend transversely of the belt with one edge only engaging the belt and extending outwardly therefrom to overlie a further conveyor belt transversely spaced from and parallel with said first conveyor belt and arranged at a lower level and which runs in the same direction but at a higher speed than the first conveyor belt, whereby an operator can pivot selected groups of blanks being fed by said first conveyor belt from engagement therewith and into engagement with said further conveyor belt, whereby thus selected groups are caused to fall backwardly and thus inverted relative to remaining groups which are allowed to fall forwardly when in engagement with the first conveyor belt.

3 Claims, 2 Drawing Figures

APPARATUS FOR TRANSPORTING BUNDLES OF FLAT ARTICLES

This invention concerns apparatus for feeding rectangular blanks of corrugated paper board from a stack thereof to a receiver for same.

In a box-making plant it is usual for the box-making machinery to be fed with rectangular blanks of corrugated paper board. The blanks of corrugated board are normally derived from stacks of same in superimposed relationship. It is not unusual for each such stack to be of a kind (hereinafter termed of the kind referred to) comprised by a plurality of superimposed bundles, the blanks in alternate bundles being inverted with respect to those in the intermediate bundles, whereby there is a tendency to reduce any warp in the board delivered by the corrugating machine.

It is necessary, however, for the blanks fed to the box-making machinery to be oriented in the same way, and it follows that during feed of blanks from a stack of the kind referred to alternate bundles of blanks must be inverted.

It is an object of the present invention to provide apparatus which facilitates the feed of blanks from a stack thereof to a receiving station, and which is particularly suitable for feeding from a stack of the kind referred to when alternate bundles of blanks need to be inverted.

According to the present invention, apparatus for feeding rectangular blanks of corrugated paper board from a stack thereof comprises means for delivering the blanks onto a first conveyor belt in such a manner that the blanks extend transversely of the belt with one edge only engaging the belt and extending outwardly therefrom to overlie a further conveyor belt transversely spaced from and parallel with said first conveyor belt and arranged at a lower level and which runs in the same direction but at a higher speed than the first conveyor belt, whereby an operator can pivot selected groups of blanks being fed by said first conveyor belt from engagement therewith and into engagement with said further conveyor belt, whereby thus selected groups are caused to fall backwardly and thus inverted relative to remaining groups which are allowed to fall forwardly when in engagement with the first conveyor belt.

The invention will be further apparent from the following description with reference to the figures of the accompanying drawing, which show, by way of example only, one form of apparatus embodying the invention.

Figure 2:
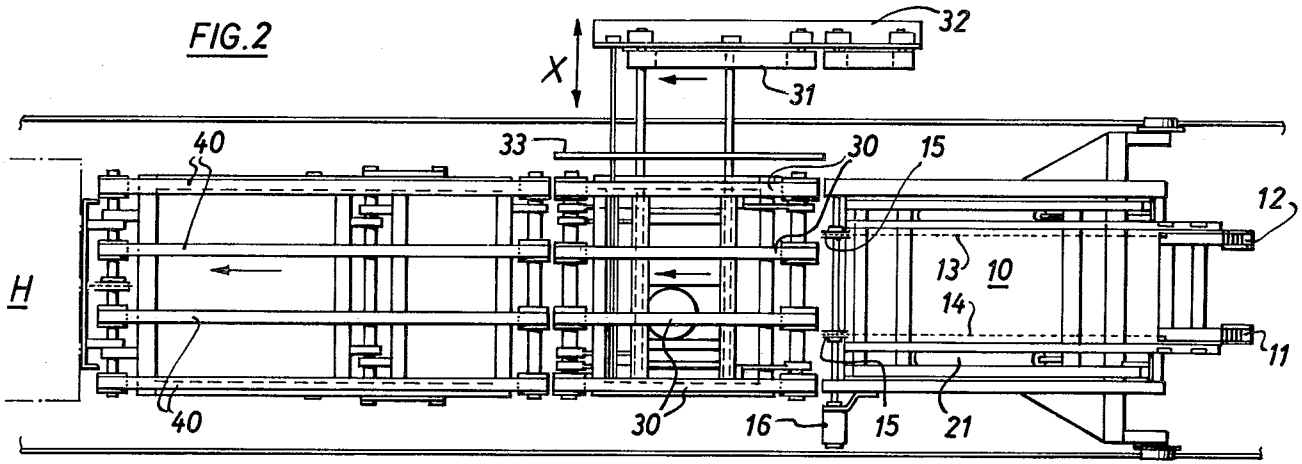
FIG. 2 shows a plan view of the apparatus.

Referring now to the drawing, it will be seen that the apparatus is essentially comprised by three sections. Thus, there is an input section A for receiving a stack of box blanks, which may be arranged in bundles forming a stack of the kind referred to, and for feeding blanks from the stack to an intermediate section B which serves to convey the blanks to a final section C which serves to deliver the blanks to a receiving station.

The section A of the apparatus includes a bed 10 which is capable of being pivoted from a vertical position (shown on FIG. 1 in chain dotted lines) to a substantially horizontal position (shown in full lines). Arms 11 and 12 extend outwardly from the bed 10 and are capable of being driven by chains 13 and 14 mounted on sprocket wheels 15 along the length of the bed in either direction by means of a motor 16.

Figure 1:
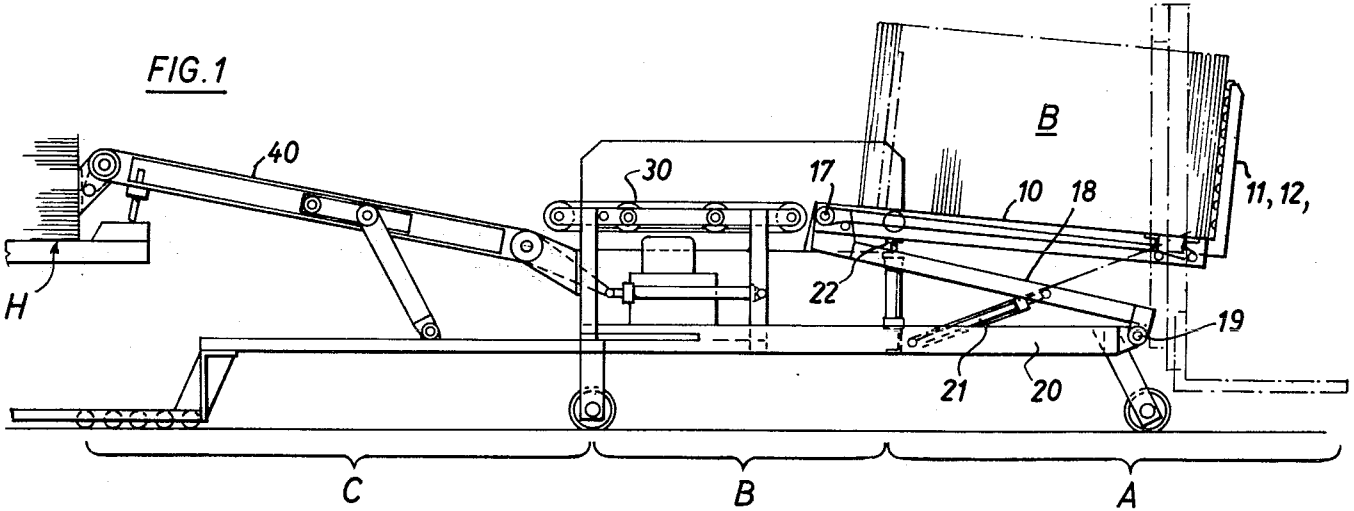
FIG. 1 shows a side elevation of the apparatus.

As best seen from FIG. 1, the bed 10 is pivotally connected at 17 to a frame 18 which is itself pivotally connected at 19 to a base frame 20 for the apparatus. The frame 18 and hence bed 10 can be raised and lowered by means of a double acting hydraulic or pneumatic cylinder 21. As the frame 18 is lowered towards its bottom position the bed 10 engages stops 22 whereby the final movement of the frame 18 downwardly causes angular separation of the bed 10 and frame 18. In this way movement of the bed 10 between its vertical and horizontal positions does not cause the arms 11 and 12 to protrude to interfere with any stacks which might be queuing in readiness for displacement onto the arms 11 and 12.

The section B of the apparatus includes a conveyor belt comprised by a plurality of conveying bands 30 spaced transversely from one another and whose upper runs move in the direction of the arrows shown whereby blanks B delivered thereonto are conveyed towards the section C. It will be noted that the overall width of the conveyor belt comprised by the bands 30 is substantially less than the width of the blanks B. A further conveyor belt 31 is provided at a transverse position corresponding with the edge of the blanks B remote from the conveyor comprised by the bands 30. The belt 31 is capable of being driven in the same direction as the bands 30 but at higher speed and is set at a lower position so that it is not normally engaged by the blanks B as they are progressed thereover by the bands 30. The belt 31 is carried on frame means 32 which are adjustable transversely in the direction of the arrows X so that it can be positioned in the manner indicated when working with blanks B of different size.

A longitudinally extending bar 33, whose purpose will be apparent hereinafter is provided between the bands 30 and 31 at the level of the former.

The section C of the apparatus comprises a conveyor belt comprised by a plurality of transversely spaced conveyor bands 40 which are capable of being driven in the direction of the arrows shown.

Operation of the apparatus is as follows.

With the bed 10 in its vertical position and the arms 11 and 12 at the lower end thereof, a stack of superimposed box blanks B is positioned on the arms 11 and 12 using a fork-lift truck or other suitable loading means. The bed 10 is then privoted by the cylinder 21 to assume its substantially horizontal position, and the arms 11 and 12 advanced by means of the motor 16 along the bed 10 to push the box blanks B from the bed 10 and onto the conveyor belt comprised by the bands 30. An operator stands in front of the section B and normally causes groups of the blanks displaced from the bed 10 to fall forwardly onto the bands 30 for transfer to the bands 40 which run at a substantially slower speed than the bands 30 whereby the groups of blanks assume ashingled configuration on the bands 40. The bands 40 deliver the blanks to the receiving hopper H of a converting machine. When, as is usual, alternate bundles of blanks in the stack have been inverted relative to the intermediate bundles, the operator lifts the corners of such alternate bundles so that they pivot about the bar 33 and engage the conveyor 31 whereby they are caused to fall rearwardly to assume the same orientation as the intermediate bundles which are caused to fall forwardly. In this way, all the blanks delivered to the hopper H are oriented in the same direction.

When the bed 10 is emptied, it is returned to its vertical position and the arms 11 and 12 are lowered for reception of the next stack.

It will be appreciated that it is not intended to limit the invention to the above example only, many variations, such as might readily occur to one skilled in the art, being possible without departing from the scope thereof.

What is claimed is:

1. Apparatus for feeding rectangular blanks of corrugated paper board comprising a first conveyor belt having a forward end disposed for delivery of blanks in predetermined forwardly falling orientation to a box making machine or the like and means for driving said belt, a second conveyor belt transversely spaced from and parallel with said first conveyor belt and adjacently arranged at a lower level and means for driving said second conveyor belt in the same direction as and at a higher speed than said first conveyor belt, means for delivering a stack of said blanks onto said first conveyor belt in such manner that the blanks are supported on only one edge on and extend substantially vertically transversely of said first conveyor belt with said edge extending outwardly to overlie said second conveyor belt but out of contact therewith, whereby selected groups of blanks on said first conveyor belt may be pivoted from engagement therewith into edge engagement with said second conveyor belt whereby said selected groups may be caused to fall backwardly upon delivery and are thus inverted relative to the blanks remaining in engagement with said first conveyor belt.

2. Apparatus according to claim 1 wherein fulcrum means about which selected groups of blanks can be pivoted extends longitudinally between said first conveyor belt and said further conveyor belt, said means being disposed at the level of the conveying surface of said first conveyor belt.

3. Apparatus according to claim 1 wherein said means for delivering the blanks onto the first conveyor belt comprises a bed which is pivoted for movement between a vertical position and a generally horizontal position, arms extending outwardly from the bed and adapted to receive a stack of boards when the bed is in its vertical position, means for moving said arms longitudinally of the bed whereby the stack of boards can be displaced from the bed when the bed is in its horizontal position to be fed therefrom onto said first conveyor belt.

* * * * *

UNITED STATES PATENT OFFICE

CERTIFICATE OF CORRECTION

PATENT NO. : 4,003,463

DATED : January 18, 1977

INVENTOR(S) : Barrie Holt et al

It is certified that error appears in the above-identified patent and that said Letters Patent are hereby corrected as shown below:

In the Foreign Application Priority Data, change "Jan. 8, 1974" to --June 8, 1974--.

Signed and Sealed this

Fifth Day of April 1977

[SEAL]

*Attest:*

RUTH C. MASON
*Attesting Officer*

C. MARSHALL DANN
*Commissioner of Patents and Trademarks*